United States Patent [19]

Arneson

[11] 4,128,169

[45] Dec. 5, 1978

[54] BOTTLE PACKAGE

[75] Inventor: Edwin L. Arneson, Morris, Ill.

[73] Assignee: Federal Paper Board Company, Inc., Montvale, N.J.

[21] Appl. No.: 852,287

[22] Filed: Nov. 17, 1977

[51] Int. Cl.[2] ..... B65D 75/14

[52] U.S. Cl. ..... 206/141; 206/434; 229/40; 229/52 BC

[58] Field of Search ..... 229/40, 28 BC, 52 BC, 229/52 B; 206/434, 44.12, 141, 429, 427, 162, 139, 143

[56] References Cited

U.S. PATENT DOCUMENTS

| | | | |
|---|---|---|---|
| 3,348,672 | 10/1967 | Brown | 229/40 |
| 3,640,448 | 2/1972 | Wood | 229/40 |
| 3,827,550 | 8/1974 | Arneson | 229/52 BC |
| 3,963,121 | 6/1976 | Kipp | 206/434 |
| 3,977,518 | 8/1976 | Arneson | 206/141 |
| 3,994,432 | 11/1976 | Kirby, Jr. | 206/141 |
| 3,999,660 | 12/1976 | Tranquillitsky | 206/141 |
| 4,034,852 | 7/1977 | Forrer | 206/141 |

*Primary Examiner*—William Price
*Assistant Examiner*—Bruce H. Bernstein
*Attorney, Agent, or Firm*—Guy A. Greenawalt

[57] ABSTRACT

A wraparound type carrier package for a group of bottles arranged in row relation and transversely aligned pairs, which carrier is especially adapted for use in marketing of bottled products, and which permits removal of the bottles without damaging the carrier and ready return of empty bottles therein so as to encourage return to the store or bottling plant for reuse or recycling, which is characterized by being formed from a flat blank of paper-board or similar foldable sheet material which is cut and scored so that it may be wrapped about the top and bottom of the bottles, with end margins of the end panels thereof being secured to each other, and with means to restrain endwise movement of the bottles out of the ends of the carrier while permitting ready removal of the bottles through apertures formed in the top wall, also having finger accommodating apertures in the top wall for carrying the package which are reinforced by underlying panels cut from material in the top wall and sidewalls in providing the bottle removing apertures and hinged into engagement with the inside face of the top wall in the area surrounding the finger accommodating apertures.

10 Claims, 10 Drawing Figures

BOTTLE PACKAGE

The invention relates to packaging and is more particularly concerned with improvements in carrier-type packages of beverage bottles or similar products which employ a single flat blank wrapped about a group of the bottles arranged in longitudinal and transverse row alignment so as to form a tubular carrier carton with provision for confining the bottles at the ends of the carton while enablng the bottles to be removed without damaging the carton or destroying its carrying capabilities.

In the packaging of bottles and canned beverages two types of carton or carrier structures have achieved extensive use in the beverage marketing industry, namely, the cellular basket-type, which is particularly adaptable for multi-trip use with products in returnable bottles, and the single trip, disposable, wraparound type, which is most often employed with products in non-returnable containers, particularly, canned beverages. With the introduction of the non-returnable or disposable beverage bottles the wraparound type has been adapted for these, also, since it employs less material and is more economical for one-trip, disposable use than the basket-type. Recently, there has been a demand for elimination of the disposable containers, and return to the reusable containers or for some arrangement for inducing the consumer to return empty containers for reuse or recycling, particularly, the disposable bottles. Also in the use of the single trip wraparound-type packages, which have been the most commonly employed for reasons of economy, a problem has been the breaking of the packages on the retail shelves by customers desiring a lesser number of bottles of the product than commonly enclosed in the wrapper. In an effort to meet the demand for a package having the economy of the single trip style package which will enable the bottles to be removed and replaced without the need for mutilating the wrapper or container to an extent which would render it unfit for reuse, that is, for the purpose of carrying the empty bottles on a return trip to the distributor, a wraparound type package has been developed which is described in U.S. Pat. NO. 3,977,518 granted to me on Aug. 31, 1976. In that package a handle structure is formed which depends from the top wall into the area between the center bottles and special machinery is required for mass production.

It is a general object of the present inventio to provide a package which invention adapted for marketing products, such as bottled beverages, which will enable ready removal of bottles from the package without destruction of its bottle retaining capabilities so as to enable replacement of empty bottles therein for return to the distributor, which is economical to produce, and which may be handled with minimum modification of known wrapper applying machinery.

A more specific object of the invention is to provide a carrier-type package for marketing bottled beverages or similar products which employs a single blank of paperboard, or similar foldable sheet material, which is cut and scored so that it may be wrapped about an assembly of bottles in double row arrangement with provision for retaining the bottles in the tubular carton thus formed while permitting removal of the bottles without damaging the carton and without destroying the bottle retaining and carrying characteristics of the carton so that it may be reused, particularly, in returning empty bottles to the distributor.

Another object of the invention is to provide a wraparound type bottle carton with provision for retaining the bottles against accidental removal from the ends of the carton while permitting ready removal of the bottles from the carton, through a pair of openings in the top wall, and with finger accommodating openings in the top wall which are reinforced by hinged panels derived from the material which is removed to provide the bottle removing openings in the top wall.

To this end the invention as claimed herein is embodied in a package employing a single blank of paperboard or other suitable foldable sheet or web material which is cut and scored so as to enable it to be wrapped about a group of bottles arranged in double row, transversely paired and longitudinal alignment, with bottle engaging means for retaining the bottles in position in the bottom of the tubular container formed by the wrapper together with cooperating means for retaining the bottles at the top, and with a pair of apertures through which bottles may be removed which are cut in part from the top wall and the top wall having finger accommodating apertures with reinforcing panels encompassing the same which are derived from the material which is cut out to provide the bottle removing apertures, enabling ready removal and replacement of bottles in the carrying container without damage to the container while reinforcing the carrying capabilities of the same.

The aforesaid objects and other objects and advantages of the invention will become more apparent when reference is made to the accompanying detailed description of the preferred embodiment of the invention which is set forth therein, by way of example, and shown in the accompanying drawings wherein like reference numerals indicate corresponding parts throughout.

Figure 1:
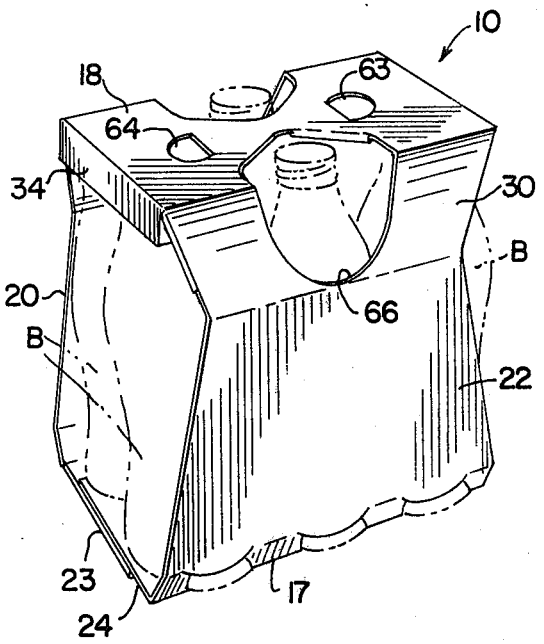
FIG. 1 is a perspective view of a set-up bottle carrier type package, which embodies the principles of the invention with the bottles being shown therein in phantom line.

Referring to the drawings, there is illustrated a carrier carton for a six bottle package and a cut and scored blank of paperboard, or similar foldable sheet material, for making the same, which embodies the principal features of the invention, and a modification thereof. It will be understood that the principles of the invention may be otherwise applied and that the following description of the carrier carton and the modified carton structure as shown in the drawings is for the purpose of setting forth the several forms of the invention which are presently preferred.

Figure 2:
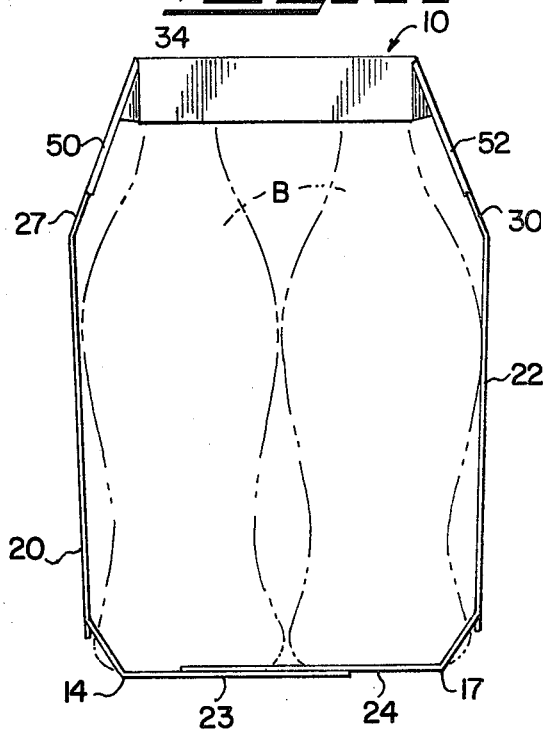
FIG. 2 is an end view of the package of FIG. 1, to a larger scale.
Figure 3:
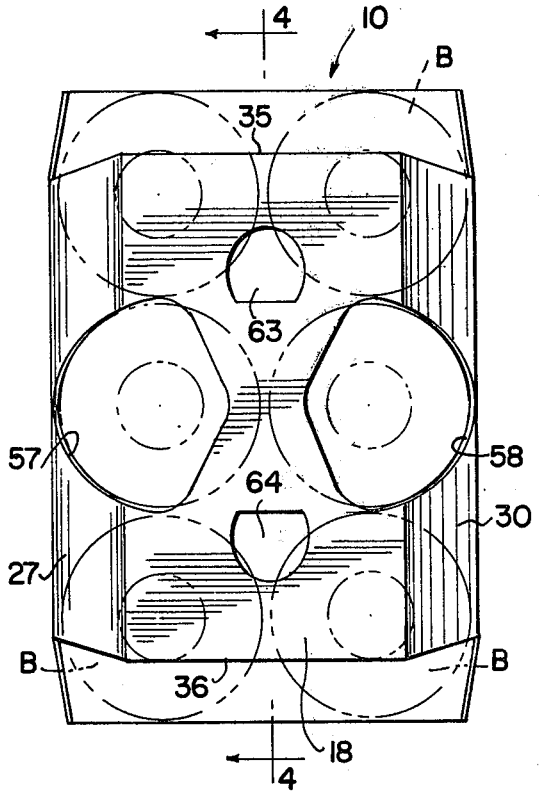
FIG. 3 is a top plan view of the package of FIG. 1, to a larger scale.
Figure 4:
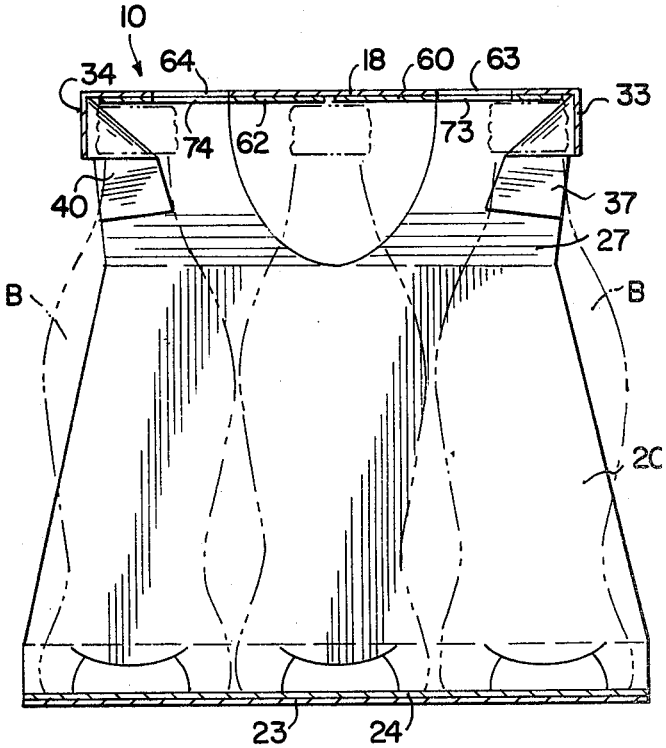
FIG. 4 is a longitudinal section taken on the line 4—4 of FIG. 3.
Figure 5:
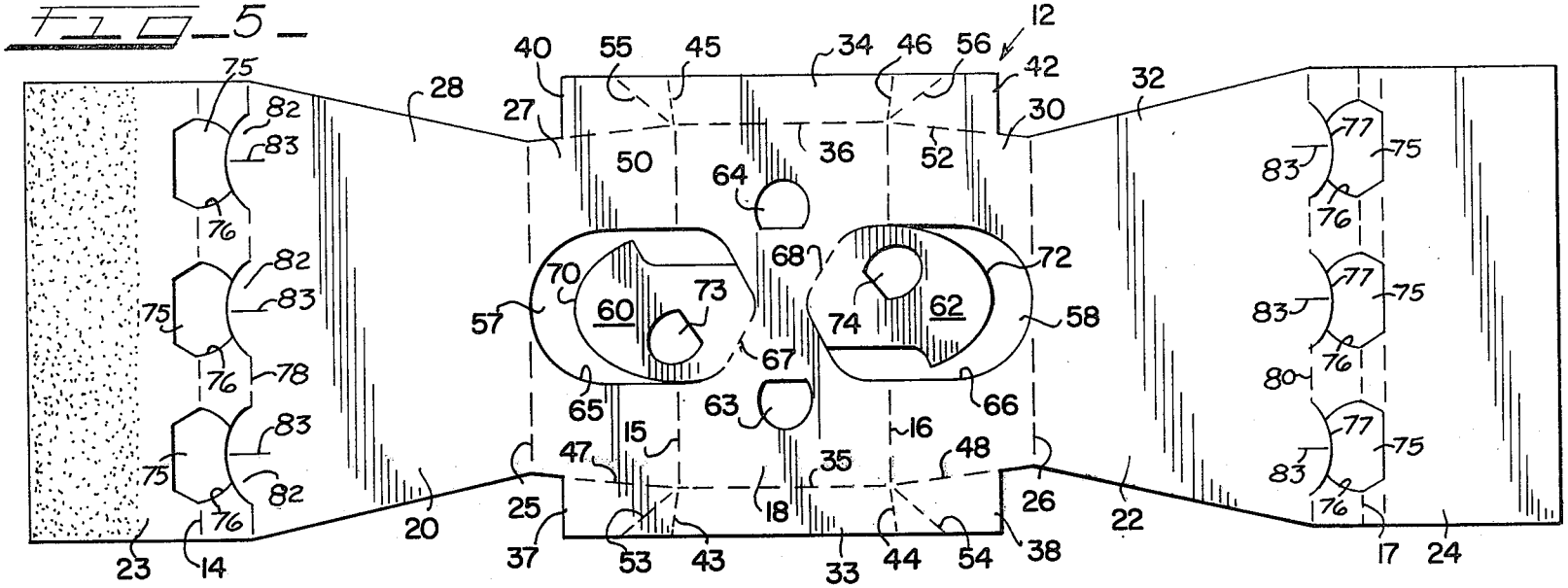
FIG. 5 is a plan view of a cut and scored blank for wrapping about an assembly of bottles to form the package illustrated in FIG. 1.

The carton structure 10 which is illustrated in FIGS. 1 to 6 is formed by wrapping the blank 12 of FIG. 5 about an assembly of beverage bottles B which are arranged in two rows of three bottles each with the bottles in transversely paired alignment. The blank 12, which is paperboard or other suitable foldable sheet material, is cut and scored as shown in FIG. 5. The blank 12, except for certain details hereinafter referred to, is symmetrical about longitudinally and transversely extending center lines. It is divided by parallel, longitudinally spaced hinge forming crease or score lines 14, 15, 16 and 17, which extend transversely of the blank, into a top wall forming center panel section 18, adjoining side wall forming panel sections 20 and 22 and bottom wall forming panel sections 23 and 24, the last mentioned being at opposite end margins of the blank 12. The sidewall forming panel sections 20 and 22 are subdivided by transversely extending score lines 25 and 26, which are parallel with and equally spaced from the score lines 15 and 16, into associated top and bottom sidewall forming panels 27, 28 and 30, 32, respectively. The dimension of the top wall forming panel section 18 in the direction longitudinally of the blank corresponds approximately to the distance between the outside edges of the capped tops of a pair of transversely aligned bottles B, which distance is less than the transverse distance at the bottom of the bottles, with the result that the top sidewall panels 27 and 30 are slanted toward each other when the wrapper is assembled about a group of bottles, the score lines 25 and 26 being located so that the panels 27 and 30 follow generally or generally conform to the upward slant of the bottle surfaces at the upper portions of the bottles, that is, the portions extending from the main portion of the bottle body to the neck portion thereof. The dimensions of the bottom sidewall panel portion 28, 32, in the direction longitudinally of the blank, correspond generally to the height of the main body portions of the bottles B. The width or transverse dimension of the major portion of the blank 12 corresponds approximately to the bottom dimension of the rows of bottles B, when grouped as shown in FIG. 3, so that when the wrapper 12 is wrapped about the group of bottles, it takes the form of a tube with open ends except for small top panels provided for restraining the bottles against removal out of the ends of the tube.

The restraining means for the top of the endmost bottles comprises relatively narrow panels 33 and 34 formed in opposite side margins of the blank 12 and extending from the opposite ends of the top wall forming panel 18. The panels 33 and 34 are separated from the panel 18 by longitudinally extending hinge or fold forming score lines 35 and 36 with the opposite ends of the panels 33 and 34 joined to the adjoining sidewall panels 27 and 30 by foldable web members 37, 38 and 40, 42 which in the set-up carton or carrier are folded so as to lie along the inside surfaces of the sidewall forming panels, as shown in FIGS. 1, 2 and 4. The top end wall panels 33 and 34 project a short distance outboard of the longitudinally extending score lines 35 and 36 with the web forming end members 37, 38 and 40, 42 defined by extensions 43, 44 and 45, 46 of the cross score lines 15, 16 and the end portions 47, 48 and 50, 52 of the longitudinal score lines 35 and 36. The web sections 37, 38 and 40, 42 are divided by score lines 53, 54 and 55, 56 which diverge outwardly from the intersections of score lines 15, 16 with the score lines 35, 36. The endmost portions of the web sections or members 37, 38 and 40, 42 extend along marginal portions of the top sidewall panels 27, 30 at opposite sides of the blank and are adapted to fold against the inside faces thereof when the package is formed.

Figure 6:
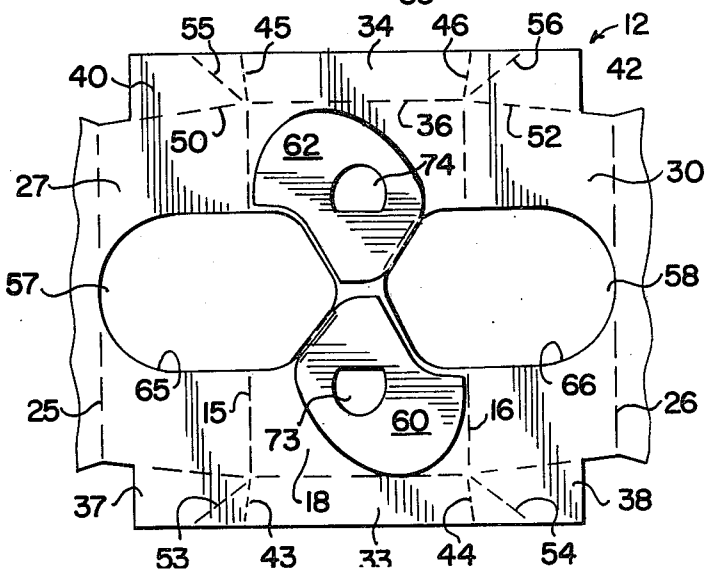
FIG. 6 is a fragmentary plan view showing a center portion of the inside face of the blank of FIG. 5 which illustrates an initial folding step in applying the blank to an assembly of bottles.
Figure 7:
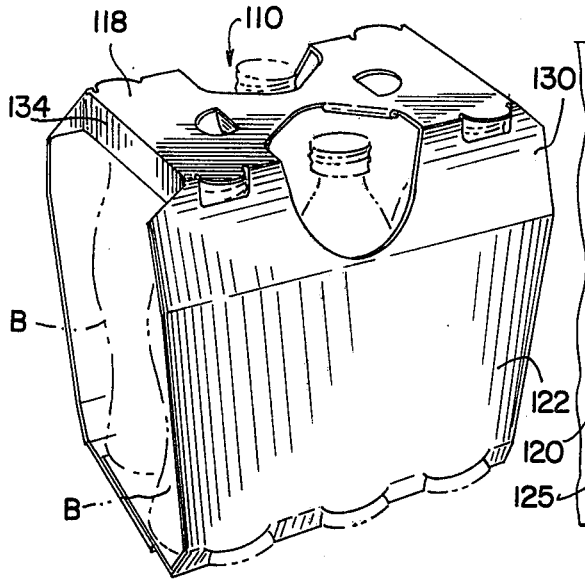
FIG. 7 is a perspective view showing a modified form of the bottle carrier type package.
Figure 9:
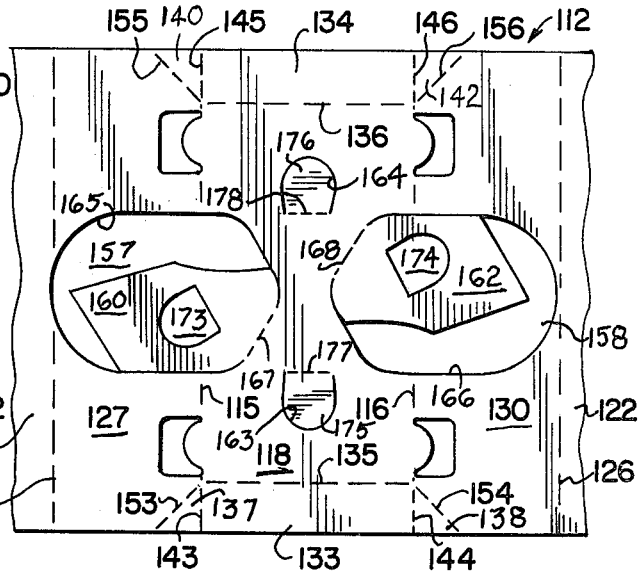
FIG. 9 is a fragmentary plan view showing a center portion of a blank which is cut and scored to form the carrier package of FIG. 7.
Figure 8:
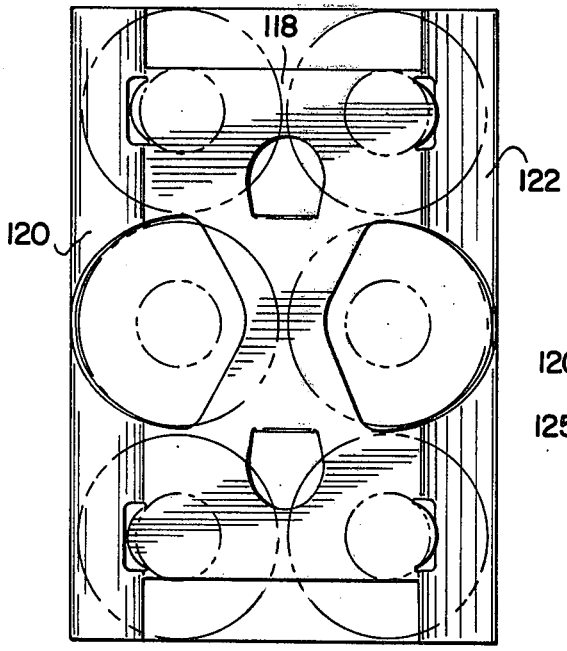
FIG. 8 is a top plan view showing the top of the carrier package of FIG. 7.

The top wall forming panel 18 and the adjoining sidewall panels 27 and 30 are cut and scored as shown in FIG. 5 to provide, when the package is formed, upwardly opening bottle removing apertures or openings 57, 58 and hinged reinforcing panels 60, 62 for finger accommodating holes or apertures 63, 64 which are cut in the top wall forming panel 18. The bottle removing apertures 57 and 58 are provided by cutting out generally elliptical areas on the lines 65 and 66 which bridge the cross score lines 15 and 16 so that the bottle removing openings 57 and 58 extend, in part, in the top wall panel 18 and, in part, in the top portions 27 and 30, respectively, of the sidewall panels 20 and 22. The cut out areas which define the bottle removing apertures or openings 57 and 58 are aligned longitudinally of the blank and spaced on opposite sides of a transverse center line in the panel 18, with the spacing being sufficient to permit bottle removal without unduly weakening the panel 18. Straight portions 67 and 68 of the lines 65 and 66 which define the bottle removing apertures 57 and 58 are not cut but are weakened by scoring or creasing to form hinge lines for folding the finger hole reinforcing panel members 60 and 62. The hinge forming crease lines 67 and 68 extend diagonally of the top wall forming panel 18 and are in spaced parallel relation so as to enable folding of the panels 60 and 62 into the position shown in FIG. 6. The panels 60 and 62 are cut out on the generally U-shaped lines 70 and 72 which extend from the opposite ends of the hinge lines 67 and 68 so as to give the panels a configuration which affords coverage of a substantial area around each of the finger hole apertures 63 and 64 without any appreciable overlap of the bottle removing apertures 57 and 58. The reinforcing panels 60 and 62 have finger accommodating apertures 73 and 74 cut therein which correspond configuration figuration to the apertures 63 and 64 in the panel 18 and which are located in the panels 60 and 62 so that they are aligned with the apertures 63 and 64 when the panels are folded into operative position in engagement with the inside face of the panel 18 (FIG. 6).

The sidewall forming panels 28 and 32 are provided at the edge forming score lines 14 and 17 with a series of apertures 75 of identical configuration which are in transversely aligned relation and straddle the hinge forming score lines 14 and 17, and which are spaced transversely of the blank in accordance with the spacing of the bottles in the lengthwise rows with pairs thereof aligned longitudinally of the blank. The apertures 75 which interrupt the bottom fold or hinge forming score lines 14 and 17 and extend a short distance into the bottom wall forming panels 23 and 24 are formed by cutting on generally C-shaped lines 76 and on curved lines 77 which extend between the ends of each of the cutting lines 76 and a short distance beyond the same to transverse fold lines 78 and 80. The cutting lines 77, which bulge or bow into the apertures 75, interrupt the fold lines 78 and 80 which are spaced toward the center of the blank from the fold lines 14 and 17. Small sidewall sections or tabs 82 are defined by the curved cuts 77 and each tab is split by a short longitudinally extending cut 83. The apertures 75 are adatped to receive the heels of the bottles so as to hold the bottles at the bottom against movement in the tightly wrapped package 10. The apertures 75 and associated elements may be formed in accordance with the disclosure in U.S. Pat. No. 3,589,593, granted to Arthur J. Weiss, on June 29, 1971.

The bottom wall forming panels 23 and 24 at the end margins of the blank 12 are shown of sufficient dimensions lengthwise of the blank to permit overlapping as shown in FIGS. 1, 2 and 4 and secured by an adhesive or other suitable fastening means. The panels 23 and 24 may be provided with locking and latching means in the free marginal portions which are overlapped and secured beneath the bottom of the bottle assembly in wrapping the blank about the assembly, for example, as shown in U.S. Pat. No. 3,589,593 or U.S. Pat. No. 3,977,581, so as to form the package 10.

The manner in which the cut and scored blank 12 is applied to the group or assembly of bottles B will be readily apparent from the drawings and the foregoing description. The blanks are designed to be fed down onto the top surfaces of the bottle assemblies with the panels 60 and 62 folded so as to lie against the inside face of the top wall panel 18 leaving openings in the top panel 18 which provide access to the center pair of bottles. The sidewall panels 27, 28 and 30, 32 are folded down along the outermost side surfaces of the bottles and the bottom wall forming panels 23 and 24 are overlapped and secured while tightly drawn toward each other so as to confine the bottles, with the bottom or outside heel portions of the bottles seated in the apertures 75. The panels 33 and 34 are turned down into a generally vertical plane so as to confine the end pairs of bottles at the tops thereof. These panels 33 and 34 may serve as advertising elements and they may be hinged outward without destruction so as to release the tops of the end pairs of bottles for removal and subsequent replacement. When the bottles are replaced the panels 33 and 34 may be hinged to bottle restraining position without destruction of the web members 37, 38 and 40, 42 which retain them in such position. Appropriate instructions for removing and replacing the bottles may be printed on the carton surface. The consumer is able to discern, generally without instructions, that the bottles may be readily removed and replaced without destroying the carton and the arrangement alerts him to the reuse capability for returning the bottles to the distributor.

In FIGS. 7 to 10 there is illustrated a modified form of the carrier package. The center portion only of the modified blank 112 is shown, it being understood that the blank arrangement may otherwise correspond to the blank 12 in FIG. 5. The blank 112 is scored to provide the top wall forming panel 118, the same as in the blank 12 of FIG. 5, with longitudinally spaced, parallel, transverse score lines 115 and 116 defining side edges of the top wall panel 118. Narrow end wall forming panels 133 and 134 are defined at opposite sides of the blank by the longitudinally extending score lines 135 and 136 and the end portions 143, 144 and 145, 146 of the transverse score lines 115 and 116. The score lines 115 and 116 extend across the full width of the blank and separate the top wall panel 118 from top sidewall forming panel portions 127 and 130 which are in turn separated from the associated bottom sidewall forming panels 120 and 122 by the score lines 125 and 126. The longitudinal score lines 135 and 136 extend between the transverse score lines 115, 116 and at their opposite ends short score lines 153, 154 and 155, 156 extend to the side edges of the blank and are angled outwardly away from the score lines 143, 144 and 145, 146 in the direction of the ends of the blank 112. The small triangular panels thus formed at the ends of the panels 133 and 134 constitute web members 137, 138 and 140, 142 connecting the end panels 133 and 134 with the top sidewall forming panels 127 and 130.

Figure 10:
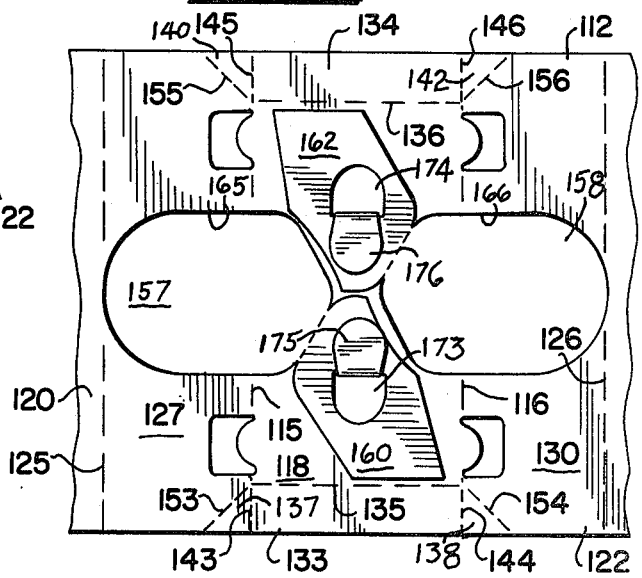
FIG. 10 is a fragmentary plan view showing a center portion of the inside face of the modified blank of FIG. 9 which illustrates an initial folding step in applying the blank about an assembly of bottles.

The top wall forming panel 118 and the adjoining sidewall forming panels 127 and 130 are cut and scored to provide, when the package is formed, upwardly opening bottle removing apertures or openings 157 and 158 with hinged panels 160, 162 being cut therein for reinforcing finger accommodating holes or apertures 163, 164 which are cut in the adjoining areas of the top wall forming panel 118. The bottle removing apertures 157, 158 are obtained by cutting out generally elliptical areas, defined by the lines 165 and 166 which bridge the cross score lines 115 and 116 so that the bottle removing openings extend, in part, in the top wall panel and, in part, in the top portions 127 and 130, respectively, of the sidewall forming panels 120 and 122. These areas in which the bottle removing openings 157 and 158 are located are aligned longitudinally of the blank and spaced on opposite sides of a transverse center line in the panel 118, with the spacing being sufficient to permit bottle removal without unduly weakening the panel 118. Finger hole reinforcing panels are formed from the material in the areas in which the bottle removing holes are cut and straight portions 167 and 168 of the lines 165 and 166 which define the apertures 157 and 158 are not cut but are scored or creased to form hinge lines for folding the finger hole reinforcing panel members 160 and 162. These hinge lines are parallel and extend diagonally of panel 118. They are spaced so as to enable folding of the panels 160 and 162 into position to cover a substantial area around the finger hole apertures 163 and 164. The reinforcing panels 160 and 162 have finger accommodating apertures 173 and 174 cut therein which correspond in configuration to the apertures 163 and 164 in panel 118 and are located so as to align with the apertures 163 and 164 when folded to lie against the panel 118. The panel 118 may have reinforcing tabs 175 and 176 cut in the areas which provide the finger hole apertures 163 and 164, which tabs may be folded on the hinge forming score lines 177 and 178 as shown in FIG. 10 to further reinforce the apertures 163 and 164 against tearing in use. The cut and scored blank 112 is, of course, folded about a bottle assembly in the same manner as described with respect to blank 12 in forming a tight wrapped package.

In several forms of the invention which are illustrated and described the blank is cut and scored for wrapping about a group or cluster of six bottles arranged in side by side, double row, and transversely paired alignment. With the six-bottle arrangement the bottle removing apertures (57, 58 in FIG. 5 and 157, 158 in FIG. 9) are located in the top wall panels in spaced oppositely disposed relation and aligned in the direction longitudinally of the blank. In forming a package of a different number of bottles, for example, eight, where the longitudinal rows contain an even number, it is desirable to locate the bottle removing apertures in a somewhat different position in the top wall panel with some possible variation in the location of the finger holes. In the six-bottle package, with three bottles in each row, the center of the group will be in a transverse plane through the center pair of bottles. The finger holes are positioned to evenly balance the weight when the fully loaded carrier is carried and the bottle removing apertures are disposed in alignment for ready removal of the center pair of bottles. In an eight-bottle arrangement the center of the group will be between the two center or inside pairs of bottles and it is desirable to offset the bottle removing apertures so that access for removal is had to diagonally opposite bottles in the two center pairs of bottles. The bottle removing apertures will then be located, not in longitudinal alignment in the blank, as in FIGS. 5 and 9, but they will be offset so that the openings or apertures are above the outermost bottles, respectively, of the two center pairs thereof when the blank is wrapped about the bottle assembly. The spaced finger accommodating holes may be offset on opposite sides of the center line of the top wall panel so as to permit location of the same to better advantage and to enable the holes in the reinforcing panels which are taken from the material which is cut out to provide the bottle removing apertures to be located in a more nearly central position in the reinforcing panels and at a farther distance from the hinged edges of the reinforcing panels, each of which defines the edges of the associated aperture so as to provide for a greater area of reinforcement between the finger holes and the adjacent edges of the bottle removing apertures. Offsetting the finger holes in this manner minimizes any tendency to tear at the edges of the finger holes and permits locating of the holes in a position which affords balancing of the weight of the package and positioning of the same for comfortable carrying.

What is claimed is:

1. A package comprising an assembly of bottles arranged in double row transversely paired alignment and a tubular carton enclosing the bottle assembly which carton is formed from a single blank of foldable sheet material with a top wall forming panel, depending sidewall forming panels and connected bottom wall forming panels, which are wrapped about the top, sides and bottom of the bottle assembly, means formed, at least in part, in said bottom wall panels for restraining the bottom ends of the endmost bottles against outward movement, means associated with the top wall panel for restraining the top ends of the endmost bottles against outward movement, said top wall panel having a pair of openings which are in the central area in the direction lengthwise of said panel through which bottles may be removed without damaging the carton, said openings being spaced transversely of said top wall panel and extending on opposite sides of the carton, said top wall panel having finger accommodating openings spaced in the lengthwise direction of said top wall panel and finger hole reinforcing panels which are taken from the otherwise waste materials cut out to form the bottle removing openings in the top wall and which are hinged to the edges of the bottle removing openings and swung into position against the inside face of the top wall panel where they underlie at least portions of the panel area around the finger accommodating openings.

2. A package comprising an assembly of bottles arranged in double row transversely paired alignment and enclosed in a carton which is formed from a blank of foldable sheet material cut and scored to provide when wrapped about the top, sides and bottom of the bottle assembly a top wall forming panel, depending sidewall forming panels and connected bottom wall forming panels, means associated with said bottom wall panels for restraining the bottom ends of the endmost bottles against outward movement, means associated with the top wall panel for restraining the top ends of the endmost bottles against outward movement, said top wall panel having a pair of transversely spaced openings which are in the central area thereof and which are of a size and configuration to permit a bottle to be removed therethrough without damaging the carton, said top wall panel having finger accommodating openings which are spaced in the lengthwise direction of said panel and reinforcing panels for said finger accommodating openings which are taken at least in part from the areas of said top wall panel from which said bottle removing openings are taken and which are disposed in engagement with portions of said top wall panel so as to form a double thickness of material and reinforce at least portions of the panel area bordering the finger accommodating openings.

3. A package as set forth in claim 2 wherein said reinforcing panels for said finger accommodation openings are folded into face engagement with and into the plane of said top wall forming panel so as to form a double thickness of material surrounding said finger accommodation openings.

4. A package as set forth in claim 3 wherein said reinforcing panels are connected in hinged relation to said top wall panel on parallel hinge lines extending diagonally of said top wall forming panel.

5. A package as set forth in claim 2 wherein each of said reinforcing panels for said finger accommodating openings is folded about a hinge line, which defines a portion of the perimeter of a bottle removing opening in said top wall forming panel, and lies against the inside face of said top wall forming panel.

6. A package as set forth in claim 2 wherein said reinforcing panels for said finger accommodating openings have finger accommodating openings which are positioned in alignment with the finger accommodating openings in said top wall panel.

7. A package as set forth in claim 6 wherein said finger accommodating openings in said top wall panel have associated hinged reinforcing tabs which may be swung into engagement with said reinforcing panels.

8. A carton blank for enclosing an assembly of articles in the form of bottles which are arranged in double row, transversely aligned pairs, said blank being generally rectangular and being divided by spaced parallel transverse score lines into a top wall forming panel, adjoining sidewall forming panels and bottom wall forming end panels, said blank being adapted to form a tube when wrapped about the top, sides and bottom of the assembly of articles, said top wall forming panel and said adjoining sidewall panels having a pair of openings cut therein which are spaced on opposite sides of the center line of said top wall forming panel which extends transversely at said blank, said openings being of a size and configuration to permit removal therethrough of articles disposed in said openings when the blank is tightly wrapped about the assembly of articles, said top wall forming panel having a pair of finger accommodating openings formed therein which are spaced transversely of the blank and which are disposed in areas adjoining the article removing openings, and reinforcing panels which constitute portions of the otherwise waste material resulting from cutting out said article removing openings, which reinforcing panels are adapted to be positioned in the plane of the top wall forming panel and which are of a size and configuration to lie against and reinforce portions of said top wall forming panel bordering said finger accommodating openings.

9. A carton blank as set forth in claim 8 wherein said reinforcing panels for said finger accommodating openings are cut in said blank so as to be integrally hinged on parallel score lines forming portions of the perimeter of said article removing openings, said score lines being located so that said reinforcing panels may be swung into engagement with the face of said top wall forming panel in the areas surrounding said finger accommodating openings.

10. A carton blank as set forth in claim 9 wherein said finger accommodating openings are formed by cutting in said top wall forming panel on lines which define reinforcing tab members adapted to be hinged into a position overlying portions of said reinforcing panels for said finger accommodating openings when said reinforcing panels are swung into engagement with said top wall forming panel.

* * * * *

UNITED STATES PATENT OFFICE

CERTIFICATE OF CORRECTION

Patent No. 4,128,169 Dated December 5, 1978

Inventor(s) Edwin L. Arneson

It is certified that error appears in the above-identified patent and that said Letters Patent are hereby corrected as shown below:

Column 4, Line 47 "configuration figuration" should be

-- in configuration --

Column 5, Line 21 "3,977,581" should be -- 3,977,518--

Signed and Sealed this

*Third* Day of *April 1979*

[SEAL]

*Attest:*

RUTH C. MASON
*Attesting Officer*

DONALD W. BANNER
*Commissioner of Patents and Trademarks*